US007908896B1

(12) United States Patent
Olson et al.

(10) Patent No.: US 7,908,896 B1
(45) Date of Patent: Mar. 22, 2011

(54) BIOMETRIC DEADBOLT LOCK ASSEMBLY

(76) Inventors: Timothy L. Olson, Phoenix, AZ (US); Paul J. Byrne, Chandler, AZ (US); Robert A. Johannsen, Chandler, AZ (US); Kenneth C. Blaisdell, Gilbert, AZ (US); John Tysver, Rockford, IL (US)

( * ) Notice: Subject to any disclaimer, the term of this patent is extended or adjusted under 35 U.S.C. 154(b) by 1154 days.

(21) Appl. No.: 11/552,043

(22) Filed: Oct. 23, 2006

(51) Int. Cl.
*E05B 49/00* (2006.01)

(52) U.S. Cl. ..... 70/278.1; 70/218; 70/223; 70/432; 340/5.2

(58) Field of Classification Search ..... 70/218–224, 70/422, 432, 278.1; 340/5.2
See application file for complete search history.

(56) References Cited

U.S. PATENT DOCUMENTS

| | | | | |
|---|---|---|---|---|
| 4,177,657 | A * | 12/1979 | Aydin | 70/278.2 |
| 4,559,796 | A * | 12/1985 | De Forrest, Sr. | 70/432 |
| 5,018,375 | A * | 5/1991 | Tully | 70/472 |
| 5,083,122 | A * | 1/1992 | Clark | 340/5.22 |
| 5,421,178 | A * | 6/1995 | Hamel et al. | 70/283 |
| 6,264,256 | B1 * | 7/2001 | Hankel et al. | 292/336.3 |
| 6,334,348 | B1 * | 1/2002 | Ming-Chih | 70/472 |
| 6,374,652 | B1 * | 4/2002 | Hwang | 70/277 |
| 6,378,344 | B1 * | 4/2002 | Gartner | 70/278.1 |
| 6,570,498 | B1 * | 5/2003 | Frost et al. | 340/540 |
| 6,725,693 | B2 * | 4/2004 | Yu et al. | 70/107 |
| 6,758,070 | B2 * | 7/2004 | Yu et al. | 70/107 |
| 6,845,642 | B2 * | 1/2005 | Imedio Ocana | 70/277 |
| 6,865,913 | B2 | 3/2005 | Yamagishi | |
| 6,868,170 | B1 * | 3/2005 | Fuku et al. | 382/124 |
| 6,980,672 | B2 | 12/2005 | Saito et al. | |
| 7,007,524 | B2 * | 3/2006 | Jasper | 70/92 |
| 7,501,930 | B2 * | 3/2009 | Cote et al. | 340/5.5 |
| 2002/0144526 | A1 * | 10/2002 | Ming-Chih | 70/218 |
| 2003/0141959 | A1 | 7/2003 | Keogh et al. | |
| 2004/0012482 | A1 | 1/2004 | Yamagishi | |
| 2004/0255628 | A1 | 12/2004 | Meyerle | |
| 2005/0050928 | A1 * | 3/2005 | Frolov et al. | 70/278.3 |
| 2006/0144103 | A1 * | 7/2006 | Blanch | 70/330 |
| 2006/0254328 | A1 * | 11/2006 | Pearson | 70/218 |
| 2007/0137267 | A1 * | 6/2007 | Pilatowicz et al. | 70/107 |
| 2007/0266747 | A1 * | 11/2007 | Rafferty et al. | 70/134 |

(Continued)

FOREIGN PATENT DOCUMENTS

CA 2249802 4/2000

(Continued)

OTHER PUBLICATIONS

Sequiam Biometrics, "BioLock", pp. 1-2, webpage www.sequiambiometrics.com.

(Continued)

*Primary Examiner* — Suzanne D Barrett
(74) *Attorney, Agent, or Firm* — Booth Udall, PLC

(57) ABSTRACT

Implementations of biometric deadbolt lock assemblies having various aspects relating to lock housing; a fingerprint sensor in the housing; a controller in the housing and electrically coupled to the fingerprint sensor, the controller configured to store data and compare stored data to data from the fingerprint sensor; a deadbolt mechanism; a manual actuator couplable to the deadbolt mechanism; a controlled actuator electrically coupled to the controller that couples or uncouples the deadbolt mechanism from the manual actuator to enable or disable manual operation of the deadbolt lock through the manual actuator. A battery may also be included within the housing and in particular implementations a biometric deadbolt lock assembly may be configured to fit in the same size opening as a conventional deadbolt lock.

39 Claims, 7 Drawing Sheets

U.S. PATENT DOCUMENTS

| | | | | |
|---|---|---|---|---|
| 2008/0011030 | A1 * | 1/2008 | Ferreira Sanchez et al. | ... 70/223 |
| 2010/0031714 | A1 * | 2/2010 | Brown et al. | ..... 70/91 |

FOREIGN PATENT DOCUMENTS

| | | | |
|---|---|---|---|
| CN | 1621649 | A | 6/2005 |
| WO | WO0103491 | | 1/2001 |
| WO | WO2005077109 | | 8/2005 |

OTHER PUBLICATIONS

Keyless Pro, "Fingerprint Biometrics Lock", pp. 1-8, webpage www.keylesspro.com/biometric.

Polymath Technology Development, "Fingerprint Deadbolt", pp. 1-7, webpage www.polymath.en.alibaba.com.

* cited by examiner

BIOMETRIC DEADBOLT LOCK ASSEMBLY

BACKGROUND

1. Technical Field

Aspects of this disclosure relate to deadbolt locking systems with a fingerprint sensor, an electronically coupled engagement, a manual rotary actuator, and a failsafe.

2. Background Art

Deadbolt locks are a standard part of both commercial and residential security. When a lock with a key is used, there is danger that a key may be lost, stolen, or forgotten. Electronic panels have been used in connection with a door lock to provide automated, keyless operation of the lock. The electronic panel mounted on a door allows users to enter a code, and will unlock the door for a correct entry. The electronic panels allow for entry with out need for a key, but there are security problems with codes as a user may forget the code or tell the code to someone who is not authorized to operate the lock. The code may also be discovered if it is written down, or through visual surveillance when a user is entering the code. Though distinct from deadbolt locks, some door handles have been modified to include a fingerprint sensor.

In electronic locking devices power consumption is a concern. Locks that automatically unlock the deadbolt mechanism instead of manually moving it through a key often use a powered motor to actuate the movement of the lock. Power consumption can be a problem, particularly in battery powered locks. In a battery powered lock, the lock typically no longer works when the batteries can no longer supply sufficient power. If the battery runs out when the mechanism is locked, the lock cannot be automatically unlocked or opened. Therefore, extending the life of the battery by operating the lock with less power is desirable to reduce the chance of a battery failure, and to increase the number of operations of the lock before the battery must be replaced. Many systems compensate for high power use by adding additional or larger batteries. Additional or larger batteries make the control portion of the electronic lock larger and more expensive to produce.

SUMMARY

Implementations and aspects of a biometric deadbolt lock with a fingerprint sensor are disclosed. Various aspects of a deadbolt lock included in this disclosure that may be applied to particular implementations individually or in combination include a biometric sensor incorporated into a deadbolt lock mechanism, an electronically coupled engagement, a manual rotary actuator, a battery incorporated within the deadbolt lock mechanism, a failsafe mechanism for potential power loss and mechanical failure, and an alternate power source adapter.

In particular implementations, a deadbolt lock includes a deadbolt locking mechanism coupled to a manual actuator, such as a rotary actuator, for manual operation of the deadbolt locking mechanism. The manual actuator interacts with a controlled actuator to allow manual movement of the deadbolt locking mechanism when the controlled actuator is activated. The controlled actuator may be controlled by a controller coupled to a fingerprint sensor. When an authorized fingerprint is sensed by the fingerprint sensor, the controlled actuator may be activated to allow manual operation of the deadbolt lock. In particular implementations, a biometric deadbolt lock mechanism may also include a battery for powering the controller, fingerprint sensor and controlled actuator. In particular implementations, a biometric deadbolt lock's mechanisms, electronics and battery are sized and arranged to fit within a housing configured to fit into a conventional deadbolt lock opening.

A biometric deadbolt lock assembly includes data storage in association with a controller for storing data from one or more authorized fingerprint scans. The biometric deadbolt lock may receive data input in one or many ways including: through the fingerprint sensor and/or through an external device communicating through a direct or wireless communication connection. In particular implementations, data may be transferred from a remote location to authorize a person to operate the deadbolt. The authorization may be for a limited time period, for a limited number of operations of the deadbolt lock, or may be limited to other conditions.

In an example method of data input for a biometric deadbolt lock assembly, a user may enter a code which changes modes for the controller to a data acquisition mode. The data may be input by passing a finger or thumb over the fingerprint sensor. The data representing the fingerprint may be stored and then the user may change modes of the controller to an operation mode. In operation mode, the user may pass a finger or thumb over the fingerprint sensor. The controller may then compare the stored data with the data from the fingerprint in operation mode. If the controller determines that the data sets match, then a signal may be sent to the controlled actuator to couple the exterior manual actuator with the deadbolt mechanism and the user may operate the deadbolt mechanism by manually moving the outer connecting actuator. An exact match of data sets may not be necessary to authorize a user.

Various implementations of a biometric deadbolt lock assembly may store additional data other than data from fingerprint scans including, for example, a log recording the use of the biometric deadbolt lock. The log may include the time and date of each time the lock was operated. The log may also include which authorized fingerprint was scanned, and data from fingerprint scans that were not authorized. The log may be transferred to an external device, such as a personal computer, which may contain additional data about the authorized users such as their name, address, phone number, company, notes, pictures and other information commonly in a database of personal information.

Data for multiple users may be input in a similar manner described above. An additional user may be added in the following manner. An authorized user may enter a code to change the mode of the controller. The code may be entered through buttons on the deadbolt lock assembly or through an external device. The code may include the authorized user passing a finger or thumb over the fingerprint sensor. A user may be authorized for purposes of operating the lock, and not authorized for purposes of adding another authorized user. Data may also be input for multiple users by having the users scan a finger or thumb on a fingerprint sensor which is external to the biometric deadbolt lock assembly. The data from the fingerprint scan may then be transferred into a biometric deadbolt lock assembly and included to identify an authorized user.

The biometric deadbolt lock assembly may include one or more indicators to indicate one of several different states. Examples of what the indicator may be indicating include but is not limited to: indicating that the fingerprint sensor is on and ready to scan; indicating that a fingerprint scan was authorized or not authorized; indicating that the battery is low and needs to be replaced; and indicating conditions when transferring data to or from the biometric deadbolt lock. The indicator may be a visual indicator such as one or more light emitting diodes, the indicator may be an audio indicator such as a speaker, or the indicator may use some other means to communicate conditions such as vibrations or brail.

A biometric deadbolt lock assembly may contain a controlled actuator that enables manual operation of the deadbolt mechanism through a manual actuator. The controlled actuator may allow the manual actuator to turn without operating the lock when the controlled actuator is not engaged. Alternatively, the controlled actuator may restrict or otherwise hinder movement of the manual actuator when it is not activated so that until a user is authorized, they cannot operate the manual actuator.

The actuator of a biometric deadbolt lock assembly may include two portions; one portion, an inner actuator, being coupled to the deadbolt mechanism, and a second portion, an outer actuator, being operated by the authorized person. The inner actuator, when activated, enables the inner and outer portion of the actuator to operate together so that operation of the outer portion of the actuator moves the inner portion of the actuator and operates the deadbolt mechanism. The actuator may be attached to the inner actuator or the outer actuator. The outer portion of the actuator may have an actuator engagement pin or teeth that extend when activated and engage the inner portion of the actuator, enabling the inner and outer portions of the actuator to move as one unit.

A biometric deadbolt lock assembly according to particular implementations that include an actuator for manual operation of the deadbolt mechanism, may thereby have the advantage of conservation of power compared to biometric deadbolt locks where the movement of the deadbolt is through an electric device or motor. By using a small amount of energy to simply engage a manual actuator, such as a knob, with the internal deadbolt mechanism rather than the larger amount of energy required to move the deadbolt mechanism itself, less energy is used and movement of the deadbolt mechanism is enabled. The energy needed to move the internal deadbolt mechanism is provided by the user. This also gives the user a tactile response to the deadbolt lock being moved to its locked or unlocked position. Particular implementations may also include a sensor to sense when the actuator may move the pin without resistance, resulting in additional reduction in power usage, thereby allowing for smaller or fewer batteries, and longer battery life. This may also reduce or eliminate the chance that the actuator would meet resistance and use excess battery power.

An external power source may also be used with particular implementations of a deadbolt lock to provide temporary power. The same electrical port used to couple the external power source may also, in some implementations, be used for external data communication with the biometric deadbolt lock assembly. Alternatively, where external data communication is desired, the assembly may be configured to include wireless data communication.

In particular implementations, the actuator having a portion with a groove structure may be able to move along the direction of the groove so that an outer actuator engagement structure may be near a first end or a second end of an inner engagement structure when activated. The outer or inner engagement structure may be spring loaded such that the engagement structures of the inner and outer portions of the actuator do not align until the portion of the actuator with the groove is manually depressed against the spring. The groove may have a slope at the second end so that when the spring returns the portion of the actuator with the groove to a rest position, the slope returns the actuator engagement structures to the non-activated position. Alternatively, where inner and outer engagement teeth or other engagement structure are used, one or both of the engagement structures may be spring loaded such that the engagement structures of the inner and outer portions of the actuator do not align until the actuator portions are engaged.

In other particular implementations, the actuator may include a manual actuator portion and a controlled actuator portion that may be selectively engaged through an annular engagement ring activated to engage when the fingerprint sensor senses an authorized fingerprint. The annular engagement ring, like the groove and slope implementation, may be configured with a failsafe feature. A visual indicator of actuator engagement status may also be included in various implementations and may include a manual disengagement mechanism. The actuator in any of the implementations may also comprise an alignment spring coupled to the manual actuator or to the outer portion of the actuator, with a rest position which aligns one portion of the actuator with another corresponding portion of the actuator for activation.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Aspects and implementations of biometric deadbolt locks will hereinafter be described in conjunction with the appended drawings, where like designations denote like elements, and.

DESCRIPTION

Figure 1:
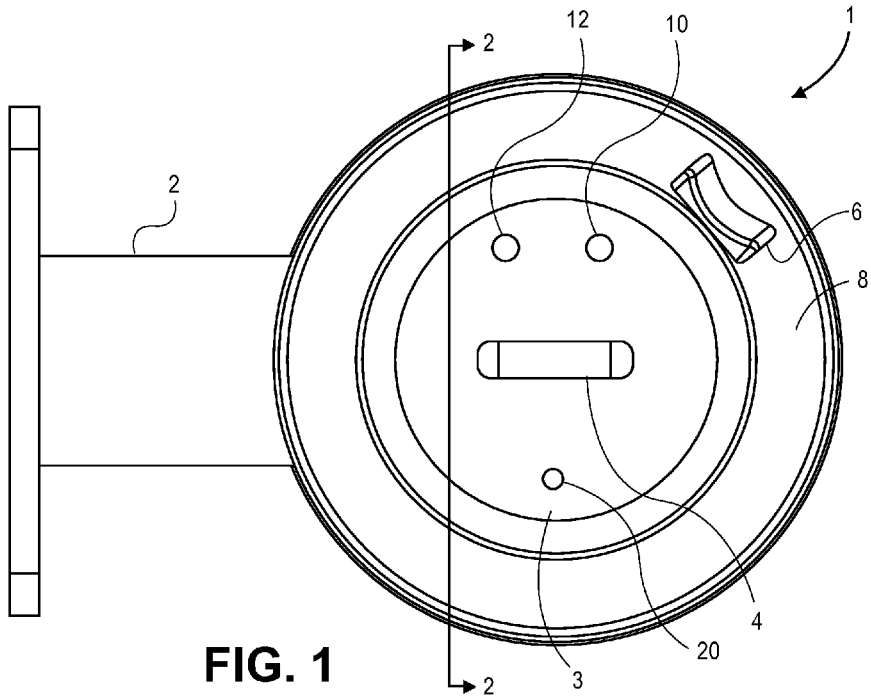
FIG. 1 is a front view of an implementation of a biometric deadbolt lock assembly.

This disclosure, its aspects and implementations, are not limited to the specific components or assembly procedures disclosed herein. Many additional components and assembly procedures known in the art consistent with the intended biometric deadbolt lock assemblies and/or assembly procedures for a biometric deadbolt lock will become apparent for use with implementations of deadbolt lock assemblies from this disclosure. Accordingly, for example, although particular implementations of biometric deadbolt lock assemblies are disclosed, such implementations and implementing components may comprise any shape, size, style, type, model, version, measurement, concentration, material, quantity, and/or the like as is known in the art for such implementations and implementing components, consistent with the intended operation of biometric and other deadbolt lock assemblies.

Reference will now be made in detail to particular example implementations of biometric deadbolt lock assemblies as illustrated by the accompanying drawings, in which drawings like reference characters designate like or corresponding parts throughout the drawings. It should be noted, however, that the inventions in their broader aspects are not limited to the specific details, representative devices, and illustrative examples shown and described in this section in connection.

Basic operation of a particular implementation of a biometric deadbolt lock assembly works as follows: A user approaches the assembly and taps a fingerprint sensor to activate the sensor and then swipes a fingerprint across the sensor. When the user receives an indication from the lock assembly that the fingerprint is authorized, the user can depress an exterior manual actuator and turn the housing of the lock approximately 90 degrees to unlock the deadbolt mechanism. The same process may be followed to lock the deadbolt mechanism but the lock would be turned approximately 90 degrees in the opposite direction. When the fingerprint is authorized and the user depresses the actuator, the housing is operably coupled to the deadbolt mechanism so that manipulation of the actuator and housing results in manipulation of the deadbolt mechanism. If the fingerprint is not authorized, the actuator and housing may turn freely, or turn 90 degrees and be biased back to its rest, and properly aligned, position but the deadbolt mechanism will not unlock. This is because without authorization, the exterior manual actuator is not operably coupled to the deadbolt mechanism. In other implementations where the actuator does not include an exterior manual actuator similar to a button, the manual actuator may be engaged by the controlled actuator automatically, without manual depression of any portion of the actuator.

FIGS. 1, 2, 3 and 4 show an implementation of a biometric deadbolt lock assembly 1 including a deadbolt mechanism 2. The lock assembly 1 and deadbolt mechanism 2 may be of a size similar to a standard key-operated deadbolt lock. Standard key-operated deadbolt lock assemblies are designed to fit within doors ranging in thickness from approximately 1.375 to approximately 1.750 inches thick comprising bore holes having a diameter of approximately 2.125 inches. The deadbolt lock assemblies have an outer casing with a diameter of approximately 2.25 to approximately 2.5 inches for the portion that rests against the door. The key assembly mechanism is typically approximately 1.375 to approximately 2.0 inches in diameter and is held in place with a collar which rests against the door. The deadbolt itself has an approximate 1" throw and is typically approximately 0.625" wide and approximately 0.75" tall.

The lock assembly 1 illustrated in FIG. 1 includes a face plate 3 with a fingerprint sensor 4 that a person may use by moving a finger or thumb across the surface. As used herein, the term "fingerprint" is intended to encompass a print from a finger and/or a thumb, or any other uniquely identifiable skin texture on a person's body part, and no other distinction will be made hereafter between them or between a person's digits. Fingerprint sensors of various types are known in the art. A bar, swipe fingerprint sensor 4 such as that shown in FIG. 1 suitable for the particular implementation shown in FIG. 1 is a UPEK TCS3 TouchStrip Fingerprint Sensor with dimensions of approximately 17.65×5×1.915 mm device or a smaller TCS4 with dimensions of approximately 14×4.5×1.5 mm. Such devices are available from UPEK, Inc., 2200 Powell Street Suite 300, Emeryville, Calif. 94608 ("UPEK"). A larger fingerprint sensor that a person uses by pressing against with a finger may alternatively be used. One example of a larger press-type fingerprint sensor is a UPEK TCS1 TouchChip Fingerprint Sensor also available from UPEK.

An exterior manual actuator comprising a depressible actuator 6 and a cover 8 is shown, with the depressible actuator 6 extending through the cover 8. The cover 8 may be able to move relative to the deadbolt mechanism 2. The cover 8 is also sometimes called all or part of a knob. The face plate 3 also has openings for a first indicator 10 and a second indicator 12. The indicators communicate to the user different conditions, such as whether an attempt to gain authorization is successful or unsuccessful. The indicators may, of course, be used in any of the implementations shown herein and those of ordinary skill in the art will readily understand how to implement the indicators into any related design in light of the description provided herein.

The optional indicators 10 and 12 shown in FIG. 1 are two light emitting diodes, but other devices which communicate conditions to the user by sight, sound, or touch, and greater or fewer than two devices may be used. Examples include, but are not limited to speakers, vibrating devices, an electronic brail panel, a liquid crystal display and similar devices.

Figure 2:
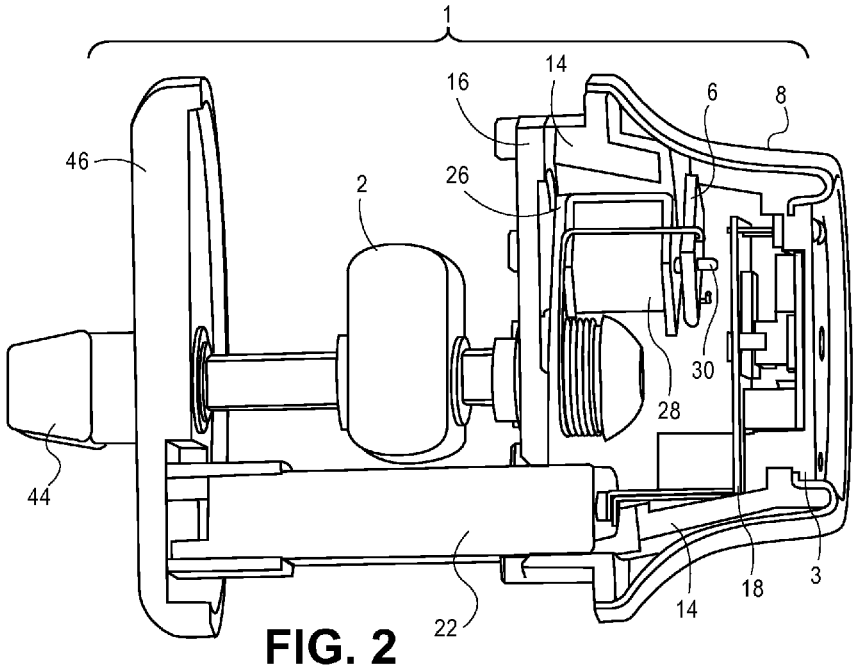
FIG. 2 shows a side cutaway view of the deadbolt lock assembly of FIG. 1, taken along line 2-2' shown in FIG. 1.
Figure 3:
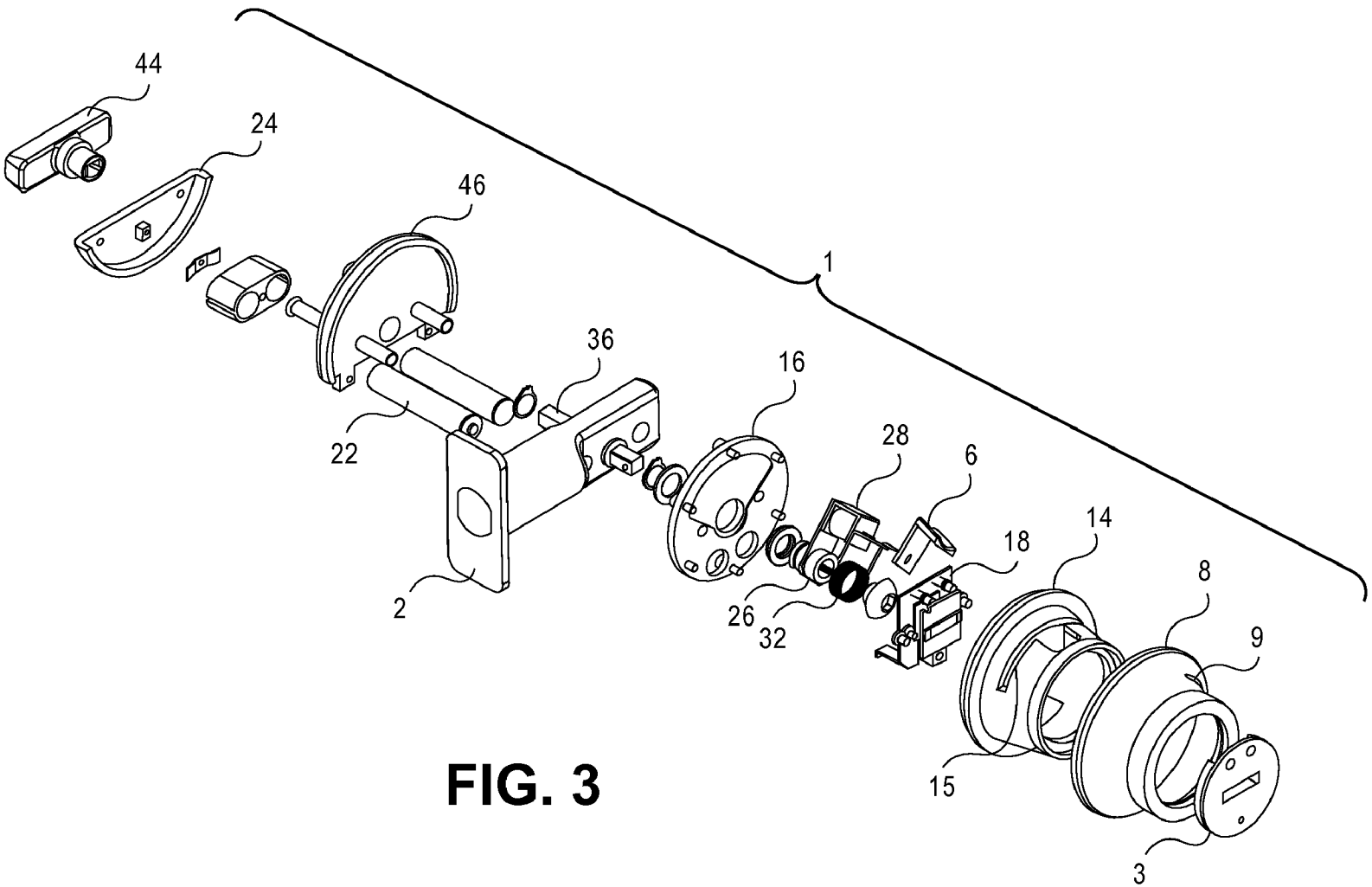
FIG. 3 shows an exploded perspective view of an implementation of a biometric deadbolt lock assembly.

In this example implementation and with further reference to FIG. 2, the face plate is included in and coupled to a housing having a controller housing 14 and a mounting plate 16. The controller housing 14 may have a slit 15 (like that shown in FIG. 3) along which the depressible actuator 6 may move. The cover 8 may have a hole 9 for the depressible actuator 6 and in particular implementations may be configured to rotate with the annular movement of the actuator so that the housing of the deadbolt lock twists to assist in moving the deadbolt mechanism. In combination, for this implementation, the depressible actuator 6, the cover 8 and the controller housing 14 form a manual actuator. Other forms of a manual actuator may also be implemented using a greater or fewer number of components, or different style of mechanism to selectively engage or be engaged by a controlled actuator like electronic actuator 28.

A controller 18 may also be coupled to the controller housing 14 and the face plate 3. The fingerprint sensor 4 may be mounted on the controller 18, on the face plate 3, or elsewhere on the assembly housing (which includes the externally exposed portions of the deadbolt lock assembly). The controller may contain memory and a separate battery to prevent loss of data in the event that the main battery fails, or during times when the main battery is changed. The controller is configured to compare data from a sensed fingerprint from the fingerprint sensor 4 with stored data from authorized fingerprints to determine if the current user is authorized to operate the lock. The controller may be electronic only, or electromechanical.

The controller 18 may also have a method of communicating with an external device such as a computer. The communication may be through an electrical port 20, or communication may be wireless through a wireless communication device associated with the controller 18.

This particular implementation of the biometric lock includes at least one internal battery 22 for powering the controller 18, the fingerprint sensor 4 and other devices. The controller 18 in this particular implementation also includes an electrical port 20 configured for connection to a portable, external power source. Electrical port 20 may be configured to receive communication data in addition to power, or there may be separate connections for communication and power. One advantage of an external power source is to provide power to operate the deadbolt lock in the event that the battery fails when the door is locked. In this situation an external power source coupled to a power port, like electrical port 20, may enable an authorized user to operate the lock, gain entry and change the battery 22.

In implementations where an internal battery is used, the inner side of the lock may include a removable battery cover 24 so that the battery 22 can be removed when the battery needs to be replaced. The controller may be configured so that the indicators 10 and 12 give an indication that the battery needs replacement, such as a light emitting diode turning on briefly at a regular interval or flashing in a predetermined pattern when a user attempts to operate the lock.

Some of the various implementations of a biometric lock shown and described herein are operated using cooperative operation of a manual actuator and a controlled actuator. In the implementation shown in FIG. 2, the controlled actuator comprises an electronic actuator 28 and a connector arm 26. The connector arm 26 may be coupled to or incorporated with an activation bar 36 which operates the deadbolt mechanism 2. The connector arm 26 may alternatively or additionally be coupled to or incorporated with an electronic actuator 28, such as a solenoid with a push-type pin configuration.

Figure 4:
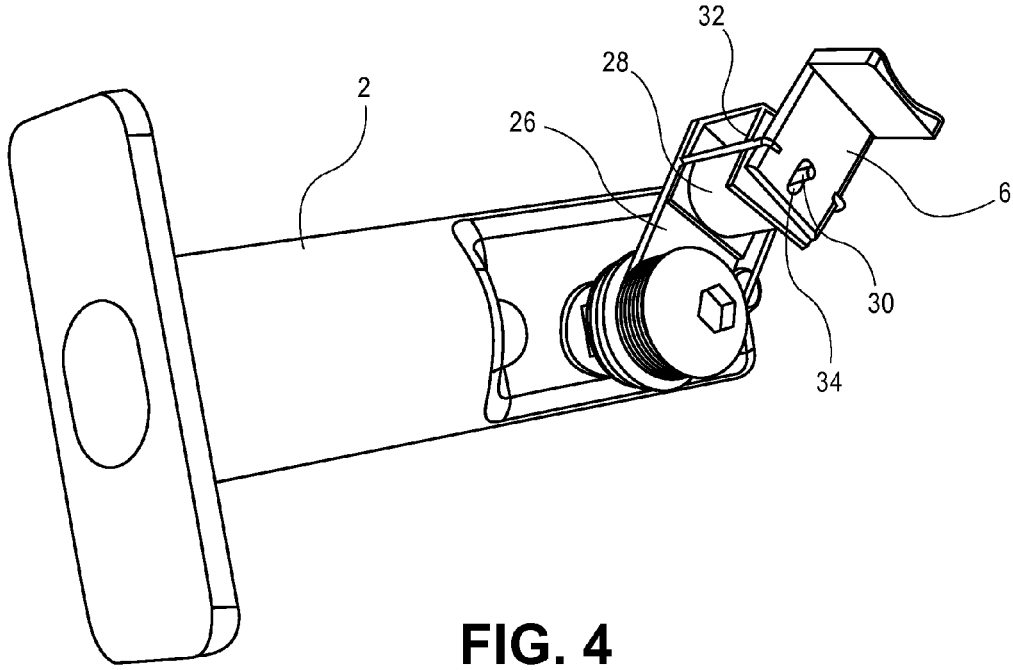
FIG. 4 is a perspective view of an implementation of an actuator for a biometric deadbolt lock assembly.

In the particular implementation illustrated by FIG. 4, the connector arm 26 is coupled to the electronic actuator 28 which is couplable with the depressible actuator 6 portion of the manual actuator through operation of the actuator engagement pin 30 and its engagement with the actuator groove 34 as shown in FIG. 4. When the electronic actuator 28 is activated by the controller 18, the depressible actuator 6 is coupled with the deadbolt mechanism 2 so that annular rotation of the depressible actuator 6 moves the deadbolt mechanism 2 components to operate the lock assembly. When the actuator engagement pin 30 is not extended into the actuator groove 34, the depressible actuator 6 is not operably coupled to the deadbolt mechanism 2 and annular rotation of the depressible actuator 6 has no effect on the position of the deadbolt mechanism 2 and will not unlock or lock the door. In the particular implementation shown in FIG. 4, the depressible actuator 6 may be depressed to a depressed position shown in FIG. 4 in the linear direction of the actuator groove 34 and may be configured with a spring or other mechanism to bias the depressible actuator 6 outward to a rest position where the actuator groove 34 is not aligned with the actuator engagement pin 30. Thus, when an authorized fingerprint is sensed, the controlled actuator and manual actuator become engaged and the authorized user is able to manually turn the manual actuator to lock or unlock the deadbolt lock. If an authorized fingerprint is not sensed, the manual actuator is not engaged with the controlled actuator and manipulating the manual actuator will not lock or unlock the deadbolt lock.

The electronic actuator 28 may be directly coupled to the connector arm 26 as shown in this example implementation, or alternatively may be directly coupled to the depressible actuator 6 with the connector arm 26 having an actuator groove. The electronic actuator 28 may alternatively be attached to the controller housing 14 or the mounting plate 16.

An alignment spring may be included to align the manual actuator with the controlled actuator through a bias. For the implementation shown in FIG. 4, the alignment spring 32 may contact both the connector arm 26 and the depressible actuator 6 and may align the electronic actuator 28 with the depressible actuator 6 so that the actuator engagement pin 30 can move into the actuator groove 34 when the electronic actuator 28 is activated.

In an alternative example implementation of an alignment feature, a biometric deadbolt lock assembly is configured where the actuator has an inner and outer portion, the controlled actuator and manual actuator may each include a magnet. The magnets in this particular implementation would use magnetic force to align a portion of the controlled actuator with the manual actuator so that the electronic actuator can extend the actuator engagement pin into the connecting actuator groove.

In a particular alternative implementation, a biometric deadbolt lock assembly includes, instead of the interior manual actuator 44 and the interior plate 46 shown in FIG. 2, a fingerprint sensor and relevant components on the inside of the door. In this particular example, an authorized user may operate the lock from the interior or exterior of the door. An unauthorized may not be able to operate the lock even from the interior side of the lock.

Figure 5:
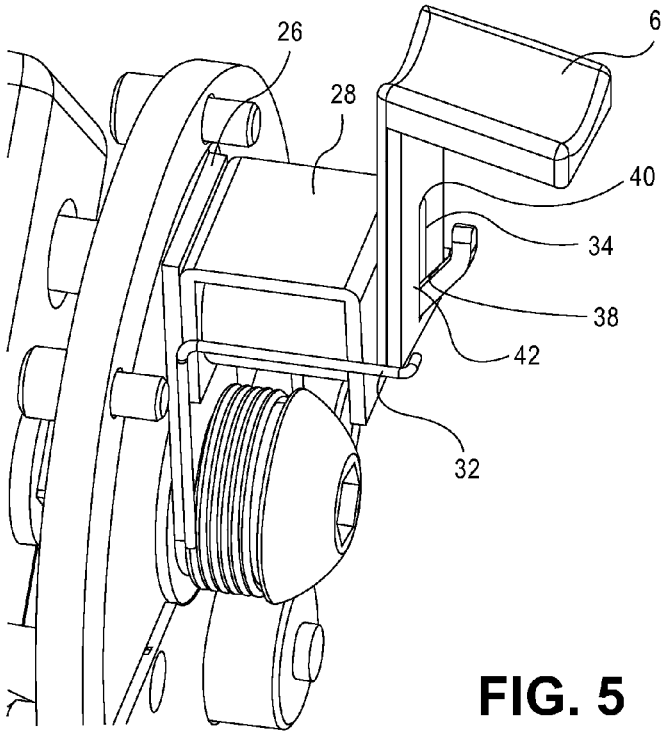
FIG. 5 is a perspective view of an implementation of an actuator without the actuator activated for use with a biometric deadbolt lock assembly with a failsafe mechanism.
Figure 6:
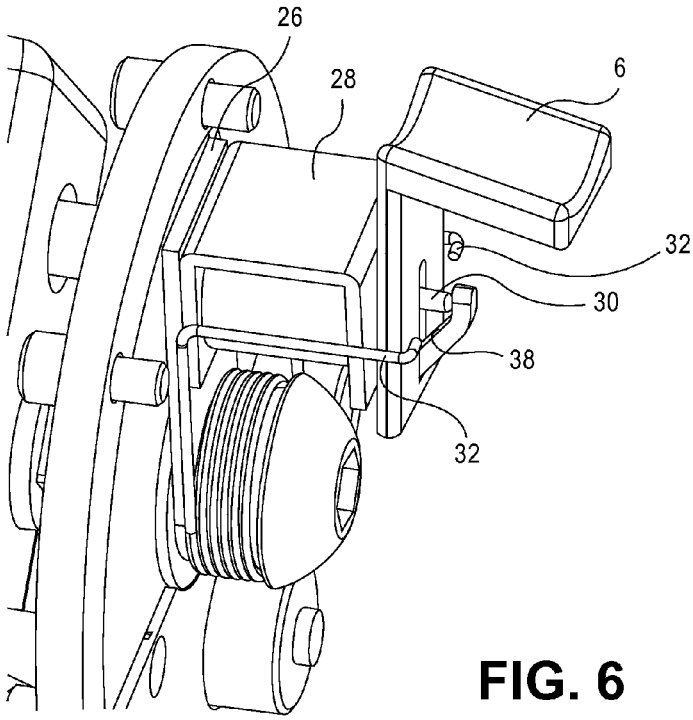
FIG. 6 is a perspective view of the actuator of FIG. 5 with the actuator activated.

FIGS. 5 and 6 show a perspective view of another implementation of an actuator in a biometric deadbolt lock assembly. In FIG. 5 the exterior manual actuator is in a first, disengaged, default state wherein the depressible actuator 6 is not depressed and the actuator engagement pin 30 from the electronic actuator 28 is not extended. To operate the lock, the user may first depress the depressible actuator 6 and then swipe a fingerprint across the fingerprint sensor 4 (FIG. 1), or swipe a fingerprint across the fingerprint sensor 4 and then depress the depressible actuator 6. When a user is authorized they may press down on the outer connecting actuator 6 and align the connecting actuator groove 34 with the actuator engagement pin 30. The actuator may include a sensor which indicates when the connecting actuator groove 30 is aligned with the actuator. The sensor may be used to enable activation of the actuator.

The actuator groove 34 as illustrated by the example implementation of FIGS. 5 and 6 may be configured to include a first end 40, a second end 42 and a slope 38. The electronic actuator 28 may include a spring coupled to the actuator engagement pin 30 and biasing the actuator engagement pin 30 to a retracted position so that when the electronic actuator 28 is de-activated the spring returns the actuator engagement pin 30 to a retracted rest position. Alternatively, or additionally, the depressible actuator 6 may also be biased to a rest position as shown in FIG. 5. The slope 38 associated with the actuator groove 34 acts as a failsafe for the biometric deadbolt lock assembly in the event of a loss of power or mechanical or debris interference with the operation of the actuator engagement pin 30. Without a failsafe, there is a risk that the electronic actuator pin 30 will not retract to uncouple the manual actuator from the deadbolt mechanism. This would allow the lock to be operated by a non-authorized user. To prevent unauthorized operation of the deadbolt in the case of a failure, the particular implementation shown in FIGS. 5 and 6 includes the slope 38 that contacts the actuator engagement pin 30 so that as the depressible actuator 6 returns through a bias to its rest position, the slope 38 pushes the actuator engagement pin 30 into a non-extended, rest position, and the depressible actuator 6 again moves independently of the connector arm 26.

One advantage of using a small-sized implementation of a biometric deadbolt lock assembly is that the door does not need to be modified, drilled or otherwise changed from a standard configuration. Further, in many implementations, a biometric deadbolt lock assembly may be removed and replaced with another standard lock without leaving holes, uneven fading of wood or other externally visible marks.

Figure 8:
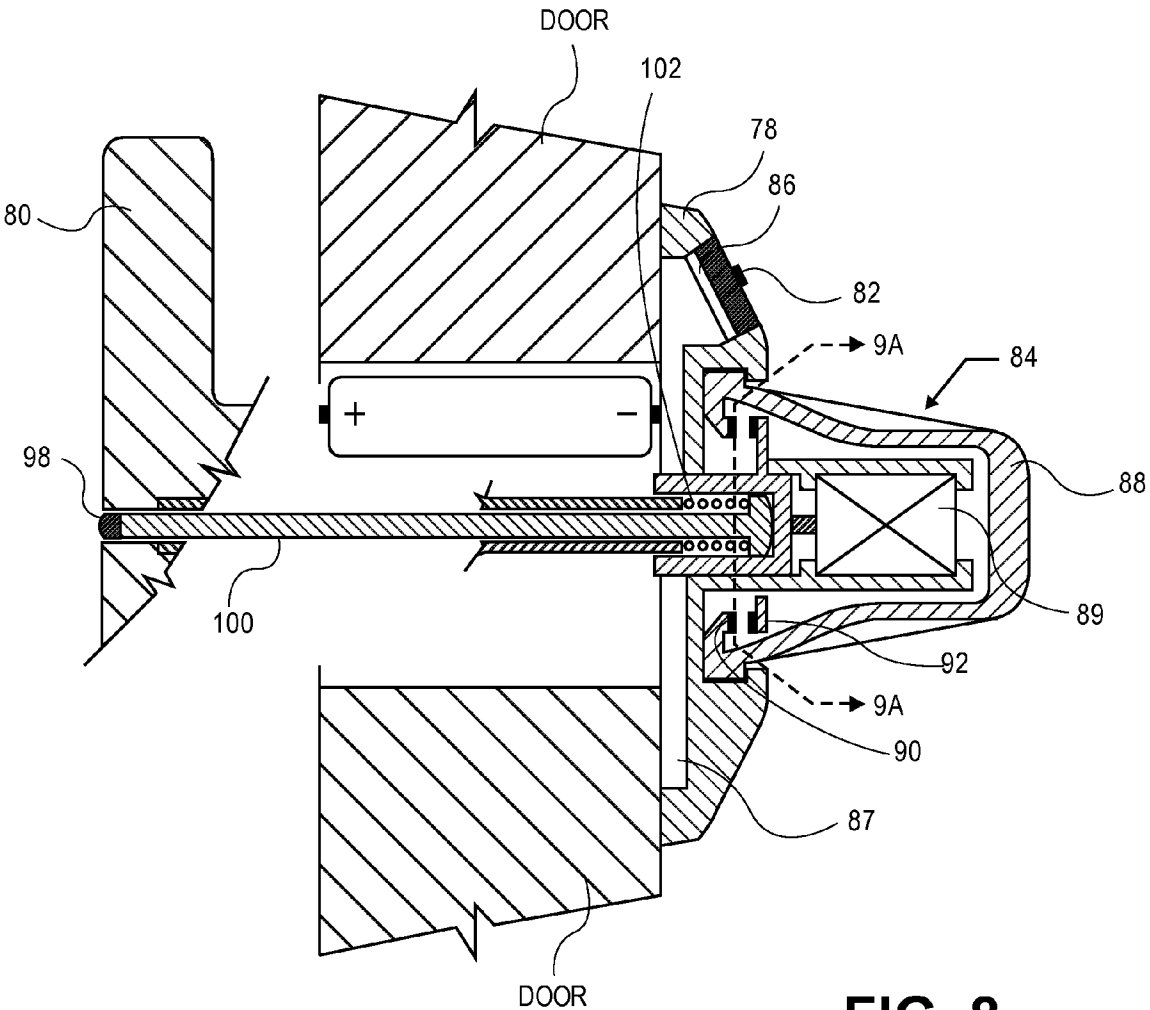
FIG. 8 is a cross-sectional view of another implementation of a biometric deadbolt lock assembly with the inner actuator portion in the non-activated position.
Figure 9A:
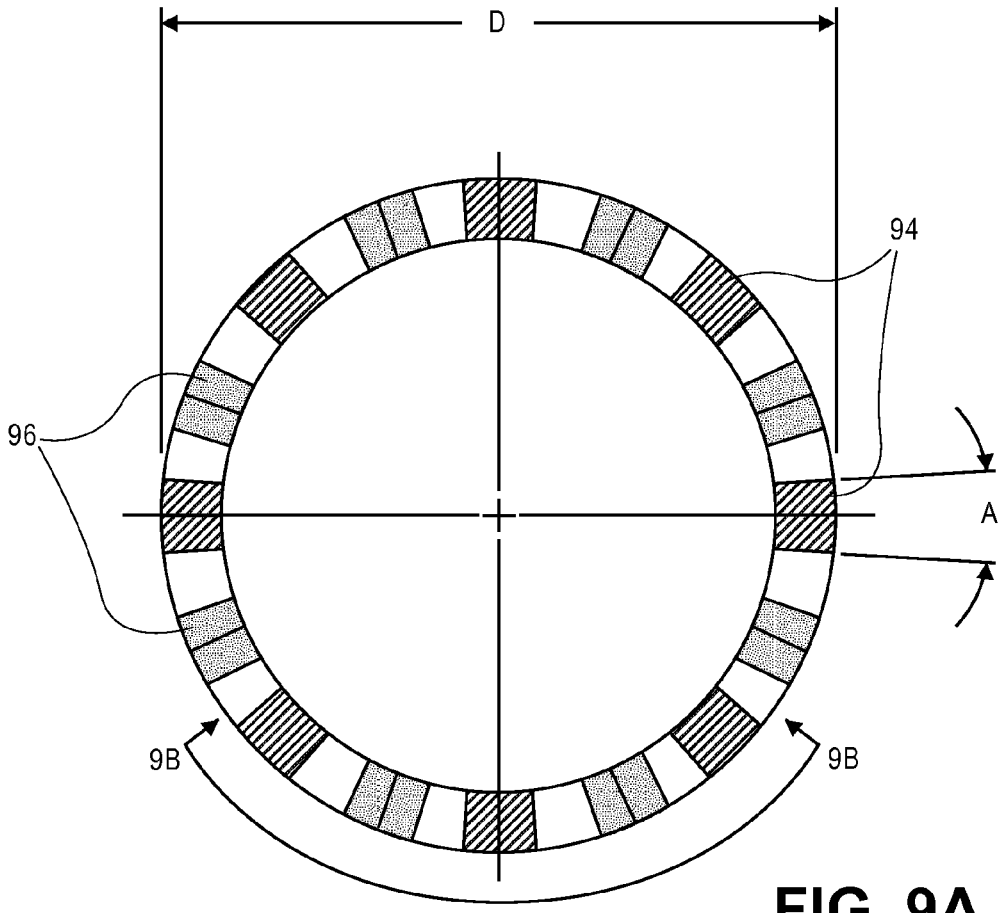
FIGS. 9*a* and 9*b* are cross sectional views of the engagement mechanism of the implementation shown in FIGS. 8 and 10 taken along section lines 9*a*-9*a* and 9*b*-9*b* respectively.
Figure 9B:
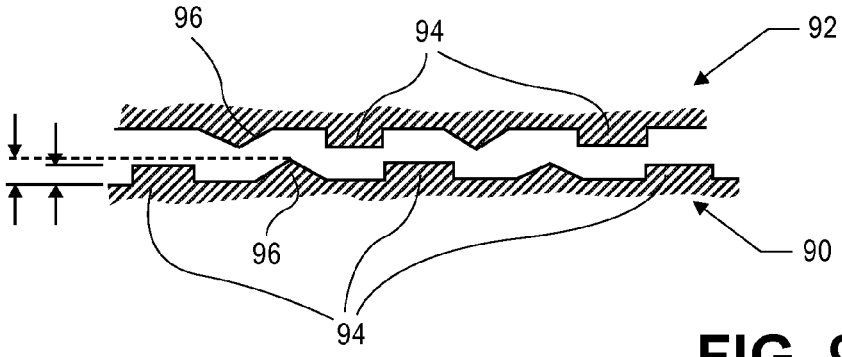
Figure 10:
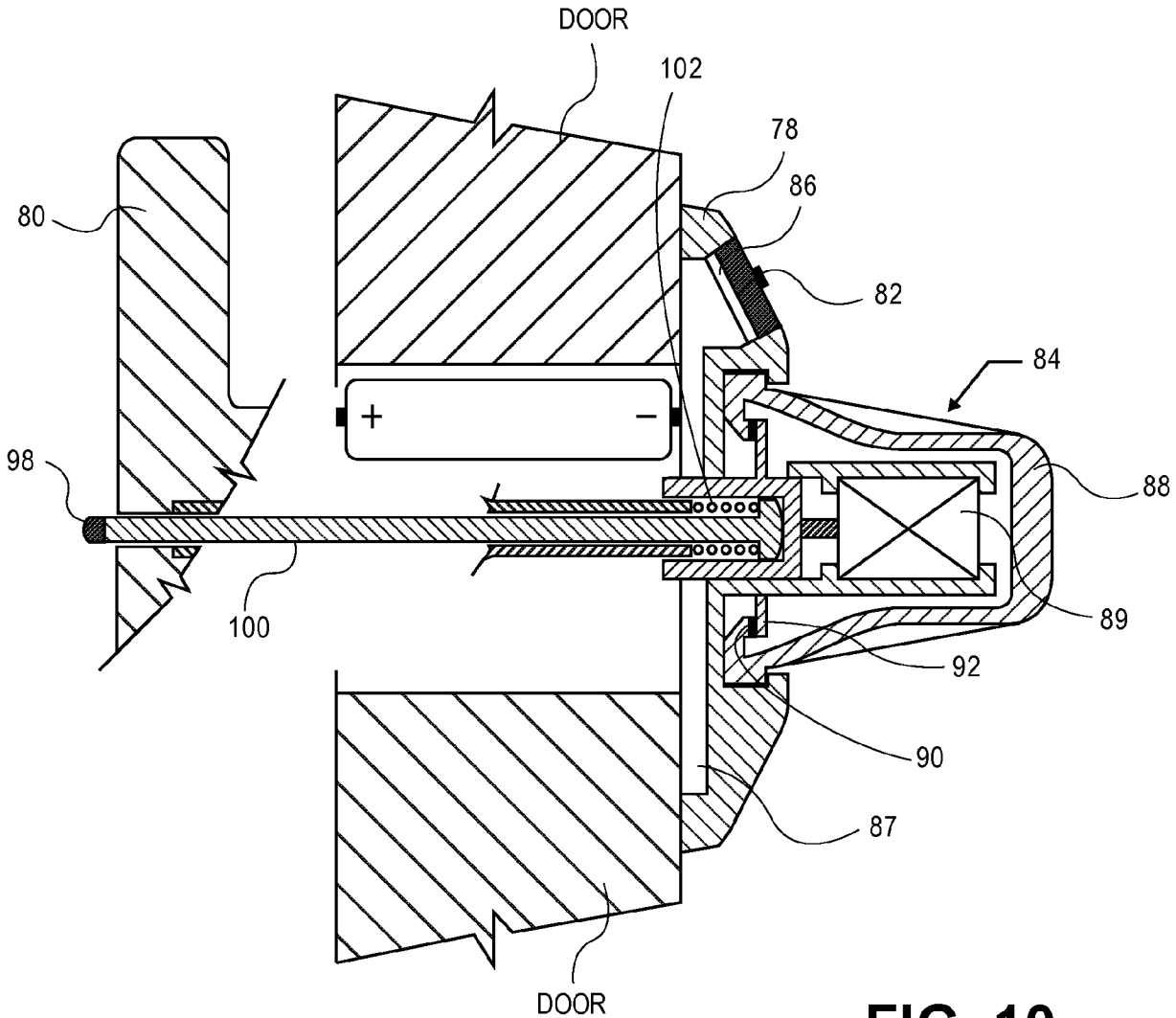
FIG. 10 is a cross-sectional view of the implementation of FIG. 8 with the inner actuator portion in the activated position.

In another particular implementation of a biometric deadbolt lock assembly, an example of the particular implementation being illustrated in FIGS. 8-10, like the example of the particular implementation illustrated in FIGS. 1 and 2, the biometric deadbolt lock assembly comprises a deadbolt mechanism (not shown) at least partially within the deadbolt assembly housing 78, an interior manual actuator 80, a fingerprint sensor 82, an exterior manual actuator 84, and a controller 86. The external manual actuator 84 of the particular implementation illustrated in FIGS. 8-10 specifically includes a knob 88 that spins freely when the exterior manual actuator 84 is in its default, disengaged state as shown in FIG. 8, and an engagement mechanism 90 coupled to, or in the particular implementation shown in FIG. 8 integral to, the knob 88. The controller 86 may comprise merely circuitry and appropriate programming to receive input from the fingerprint sensor 82 and forward appropriate signals to cause the external manual actuator 84 to become engaged with the deadbolt mechanism. Alternatively, the controller 86 may include additional components to cause mechanical engagement. The circuit board for the controller 86 may be made larger and use the space in opening 87, or opening 87 could be removed or filled in particular implementations. The additional components for this particular implementation include a push-type solenoid 89, a manual disengagement mechanism 100, a bias spring 102, a second engagement mechanism 92 and an internal visual indicator 98. Whether the additional components are treated or considered as part of the external manual actuator 84, as part of the deadbolt mechanism, or as part of the controller 86 is equivalent and insignificant to the purpose and function of the device.

As illustrated by FIGS. 8-10, for this particular implementation an annular engagement mechanism 92 that comprises engagement teeth 94 and disengagement ramps 96 (FIGS. 9*a* and 9*b*) is movably mounted within the biometric deadbolt lock assembly. The assembly for engaging and disengaging the external manual actuator 84 from the deadbolt mechanism includes two mating engagement mechanisms 90 and 92 that each include engagement teeth 94 and disengagement ramps 96. FIG. 9*a* illustrates a face-view of engagement mechanism 92 illustrating the face of each of the engagement teeth 94 and disengagement ramps 96 taken along section line 9*a*-9*a* of FIG. 8. FIG. 9*b* is a side view of a section of the engagement teeth 94 and disengagement ramps 96 marked by section 9*b*-9*b* in FIG. 9*a*. Although it is not required, the second engagement mechanism 92 has a matching pattern on its face to mate with the first engagement mechanism 90. Although the particular dimensions of the engagement mechanisms 90 and 92 are not crucial to operation of the device, it is desirable that they fit within the biometric deadbolt lock assembly housing. An initial design for the engagement mechanisms, for example, has a diameter D of 1.375 inches, an engagement tooth angle A of 11.25 degrees and an engagement tooth height of 0.050 inches. Other dimensions are contemplated. These dimensions are provided for exemplary purposes only and are not crucial to operation of every implementation of a biometric deadbolt lock.

For the implementation of FIGS. 8-10, an internal visual indicator 98 is included on an end of a manual disengagement mechanism 100 that is associated with the second engagement mechanism 92. The manual disengagement mechanism 100 and the second engagement mechanism 92 are physically biased by a spring 102 to be disengaged as the default state. When an authorized fingerprint is recognized by the fingerprint sensor 82, the controller causes the push-type solenoid 89 to push the second engagement mechanism 92 against the first engagement mechanism 90 for a predetermined time. External visual indicators and an external connection, like those illustrated in FIG. 1, may also included in particular implementations to indicate that the fingerprint is authorized. Once the first and second engagement mechanisms 90 and 92 are engaged, the knob 88 may be turned to either lock or unlock the deadbolt mechanism. When the push-type solenoid 89 is pushing, the internal visual indicator 98 extends from the internal manual actuator 80. When the push-type solenoid 89 stops pushing and retracts, the bias spring 102 biases the internal visual indicator 98 back into the internal manual actuator 80. Thus, when the engagement mechanisms 90 and 92 are engaged, annular rotation of the external manual actuator 84 causes the engagement teeth 94 of engagement mechanisms 90 and 92 to meet, causing the deadbolt mechanism to turn to unlock or lock the biometric deadbolt lock. When the engagement mechanisms 90 and 92 are in a disengaged state, the external manual actuator 84 will turn unencumbered and will not affect the deadbolt mechanism.

If, for some reason, the push-type solenoid 89 gets jammed or does not retract, or the second engagement mechanism 92 does not disengage from the first engagement mechanism 90, pushing on the internal visual indicator 98 will cause the external manual actuator 84 to manually disengage from the deadbolt mechanism. Alternatively, if the second engagement mechanism 92 does not disengage from the first engagement mechanism (as may happen if the batteries run low), twisting the knob 88 in a direction opposite the direction it was previously twisted, will cause the disengagement ramps 96 of the engagement mechanisms 90 and 92 to push the first and second engagement mechanisms 90 and 92 apart from each other. As illustrated in FIG. 9*b*, the disengagement ramps 96 are slightly taller than the engagement teeth 94. For example, the engagement teeth may have a height of approximately 0.050 inches and the disengagement ramps may have a height of approximately 0.055 inches. If the solenoid 89 is not forcing the engagement mechanisms 90 and 92 together, when the knob 88 is twisted, the disengagement ramps 96 will force the engagement mechanisms 90 and 92 apart. Optionally, an alignment mechanism, or at least a selective positioning mechanism that ensures the engagement teeth 94 and disengagement ramps 96 will be properly positioned when the solenoid 89 fires, may be included in association with one or both of the engagement mechanisms 90 and 92.

Separate from the deadbolt assembly housing, or equivalently incorporated into the deadbolt assembly housing, an additional shield or cover may be incorporated into particular implementations to provide protection and/or aesthetic affect to the fingerprint sensor.

Figure 7:
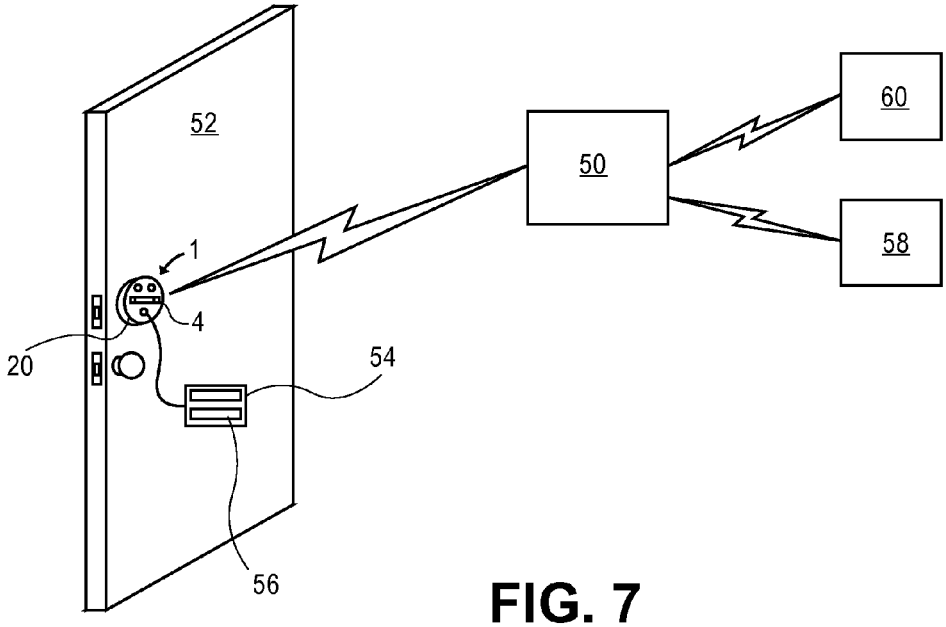
FIG. 7 is a system block diagram of an external tracking and operation system for a biometric deadbolt lock.

FIG. 7 illustrates a system for tracking and/or operating a biometric deadbolt lock 1 mounted on a door 52. While a controller for a biometric deadbolt lock assembly may be configured to receive programming to add additional authorized fingerprints through the fingerprint sensor 4 by entering a programming mode, and to log the use of authorized users of the deadbolt lock, a remote system may be used to provide additional functionality and tracking options. A remote computer 50, such as a personal computer or network server, may be configured with software to receive input relating to new users and authorized fingerprints. In implementations where the controller of the deadbolt lock assembly 1 is configured with a wireless transmitter and receiver, the remote computer 50 may transmit and receive data wirelessly. The remote computer 50 may be configured for tracking only a single deadbolt lock, or to track and adjust multiple deadbolt lock assemblies 1, 58 and 60 on a variety of doors.

Software configured for tracking may further be configured for enabling or disabling particular authorized fingerprints during certain hours. For example, an exterminator or house cleaner may be given access once during a short period of time to allow for particular work to be done, or particular employees may be granted access only during working hours.

In a particular implementation, an apartment complex is configured to include a biometric deadbolt lock on each of a plurality of apartment doors in the complex and on the pool house. Each time a tenant changes, rather than being required to change the locks on the doors, the apartment manager needs only to reprogram the lock with a different set of authorized fingerprints, either remotely by wireless connection or by direct connection through the electrical port on the lock assembly. The software can readily be configured to track such data. For the pool house, because the apartment manager already has a set of authorized fingerprint scans for each tenant, those same data files can be associated with the pool house lock for providing access during authorized times.

The biometric deadbolt lock assembly 1 shown in FIG. 7 also includes an external power source 54 coupled to the deadbolt lock through the electrical port 20. The external power source 54 of this implementation includes batteries 56, but any type of external power source compatible with the biometric deadbolt lock assembly may be used. The external power source 54 may also, or alternatively, be configured to gather or transmit data to the controller of the deadbolt lock to update authorized fingerprint data or download a use tracking log through direct connection to the deadbolt lock. The corresponding data port for the external power source 54 may be included on the housing on either the interior or exterior of the door 52.

A biometric deadbolt lock assembly includes data storage in association with a controller for storing data from one or more authorized fingerprint scans. The biometric deadbolt lock may receive data input in one or many ways including: through the fingerprint sensor and/or through an external device communicating through a direct, such as through the external power source data port, or wireless communication connection. In particular implementations, data may be transferred from a remote location to authorize a person to operate the deadbolt lock. The authorization may be for a limited time period, for a limited number of operations of the deadbolt lock, or may be limited to other conditions. The biometric deadbolt lock controller may be programmed or have settings established through this external device communication.

In an example method of data input for a biometric deadbolt lock assembly, a user may enter a code which changes modes for the controller to a data acquisition mode. The data may be input by passing a finger or thumb over the fingerprint sensor. The data representing the fingerprint may be stored and then the user may change modes of the controller to an operation mode. In operation mode, the user may pass a finger or thumb over the fingerprint sensor. The controller may then compare the stored data with the data from the fingerprint in operation mode. If the controller determines that the data sets match, then a signal may be sent to the actuator to activate the controlled actuator to thereby couple the manual actuator with the deadbolt mechanism so that the user may operate the lock by rotating the manual actuator. An exact match of data sets may not be necessary to authorize a user.

Various implementations of a biometric deadbolt lock assembly may store additional data other than data from fingerprint scans including, for example, a log recording the use of the biometric deadbolt lock. The log may include the time and date of each time the lock was operated. The log may also include which authorized fingerprint was scanned, and data from fingerprint scans that were not authorized. The log may be transferred to an external device, such as a personal computer, which may contain additional data about the authorized users such as their name, address, phone number, company, notes, pictures and other information commonly in a database of personal information.

Data for multiple users may be input in a similar manner described above. An additional user may be added in the following manner. An authorized user may enter a code to change the mode of the controller. The code may be entered through buttons on the deadbolt lock assembly or through an external device. The code may include the authorized user passing a finger or thumb over the fingerprint sensor. A user may be authorized for purposes of operating the lock, and not authorized for purposes of adding another authorized user. Data may also be input for multiple users by having the users scan a finger or thumb on a fingerprint sensor which is external to the biometric deadbolt lock assembly. The data from the fingerprint scan may then be transferred into a biometric deadbolt lock assembly and included to identify an authorized user.

The implementations and examples set forth herein were presented in order to best explain various aspects relating to biometric deadbolt lock assemblies and their practical applications, and to thereby enable those of ordinary skill in the art to make and use the inventions. Nevertheless, those of ordinary skill in the art will recognize that the foregoing description and examples have been presented for the purposes of illustration and example only, and not for restriction in any way. The description as set forth is not intended to be exhaustive or to limit the inventions to the precise forms disclosed. Many modifications and variations are possible in light of the teachings above without departing from the spirit and scope of the forthcoming claims. All changes that come within the meaning of and range of equivalency of the claims are intended to be embraced therein.

The invention claimed is:

1. A biometric deadbolt lock assembly comprising:

deadbolt assembly housing;

a deadbolt mechanism at least partially within the deadbolt assembly housing;

an interior manual actuator operatively coupled to the deadbolt mechanism;

a fingerprint sensor in the deadbolt assembly housing and accessible from outside of the deadbolt assembly housing;

an exterior manual actuator selectively engageable with the deadbolt mechanism and having a disengaged default state; and a controller within the deadbolt assembly housing, the controller electronically coupled to the fingerprint sensor;

wherein the controller is configured to couple the exterior manual actuator with the deadbolt mechanism by moving a first engagement mechanism within the exterior manual actuator toward the interior manual actuator to engage a second engagement mechanism within the exterior manual actuator in response to receiving an indication that an approved fingerprint has been received at the fingerprint sensor.

2. The biometric deadbolt lock assembly of claim 1, wherein the assembly is sized and shaped to fit within a conventional deadbolt lock assembly opening in a door.

3. The biometric deadbolt lock assembly of claim 1, further comprising at least one battery contained within the housing between the interior manual actuator and the exterior manual actuator.

4. The biometric deadbolt lock assembly of claim 1, further comprising a controlled actuator coupled to the deadbolt mechanism and engageable to the exterior manual actuator, the controlled actuator having a push-type actuator housed within the exterior manual actuator; wherein the controller is further configured to cause the push-type actuator activate to cause the deadbolt mechanism and the exterior manual actuator to engage through the first and second engagement mechanisms upon receiving the indication that an approved fingerprint has been received.

5. The biometric deadbolt lock assembly of claim 4, wherein upon activation of the push-type actuator, annular rotation of the manual actuator operates the deadbolt mechanism.

6. The biometric deadbolt lock assembly of claim 5, wherein the manual actuator comprises a depressible actuator comprising a depressed position in which the push-type actuator can engage the depressible actuator and a raised position in which the push-type actuator cannot engage the depressible actuator.

7. The biometric deadbolt lock assembly of claim 6, wherein movement of the depressible actuator from the depressed position to the raised position disengages the push-type actuator from the depressible actuator if it was engaged in the depressed position.

8. The biometric deadbolt lock assembly of claim 7, wherein the exterior manual actuator is biased from an actuated position to a rest position, wherein in the rest position the depressible actuator is aligned with the push-type actuator for engagement.

9. The biometric deadbolt lock assembly of claim 6, wherein the depressible actuator comprises an actuator groove therein, the actuator groove having associated therewith a sloping portion; wherein the push-type actuator comprises an actuator engagement pin that engages the depressible actuator by insertion into the actuator groove; and wherein movement of the outer actuator from the depressed position to the raised position causes the sloping portion to translate across the actuator engagement pin, pushing the actuator engagement pin to disengage from the depressible actuator.

10. The biometric deadbolt lock assembly of claim 1, wherein the exterior manual actuator comprises a rotatable knob.

11. The biometric deadbolt lock assembly of claim 1, wherein the first and second engagement mechanisms each comprise a plurality of engagement teeth and a plurality of disengagement ramps.

12. The biometric deadbolt lock assembly of claim 1, further comprising an interior visual indicator configured to physically indicate when the exterior manual actuator is engaged with the deadbolt mechanism.

13. The biometric deadbolt lock assembly of claim 12, wherein actuation of the interior visual indicator disengages the exterior manual actuator from the deadbolt mechanism.

14. The biometric deadbolt lock assembly of claim 1, wherein the controller is configured to receive fingerprint data relating to a plurality of authorized fingerprints through the fingerprint sensor in the deadbolt assembly housing.

15. The biometric deadbolt lock assembly of claim 1, wherein the controller comprises memory configured to store a plurality of authorized fingerprints.

16. The biometric deadbolt lock assembly of claim 1, further comprising an external cable connection in the deadbolt assembly housing and accessible from outside of the deadbolt assembly housing.

17. The biometric deadbolt lock assembly of claim 16, wherein the electrical port is configured for transmitting at least one of power to the controller and communication between an external data source and the controller.

18. The biometric deadbolt lock assembly of claim 1, further comprising a wireless communication device associated with the controller and configured for wireless communication between the controller and an external data source.

19. The biometric deadbolt lock assembly of claim 1, further comprising at least one indicator electrically coupled to the controller and configured to indicate a result of a comparison by the controller of a received fingerprint and data relating to at least one approved fingerprint.

20. The biometric deadbolt lock assembly of claim 19, wherein the at least one indicator comprises at least one of a light emitting diode and an audio indicator.

21. A self-contained biometric deadbolt lock assembly comprising:

a deadbolt assembly housing;

a deadbolt mechanism at least partially in the deadbolt assembly housing;

at least one battery in the deadbolt assembly housing;

a fingerprint sensor in the assembly housing and accessible from outside of the assembly housing;

a controller within the housing, the controller electronically coupled to the fingerprint sensor and associated with memory storing data indicating at least one approved fingerprint;

an exterior manual actuator selectively couplable with the deadbolt mechanism;

at least one visual indicator in the assembly housing and viewable from outside of the assembly housing to physically indicate when the exterior manual actuator is engaged with the deadbolt mechanism, the visual indicator coupled to the controller and configured to indicate a result of a comparison by the controller of a received fingerprint and the data relating to the at least one approved fingerprint, wherein actuation of the interior visual indicator disengages the exterior manual actuator from the deadbolt mechanism; and wherein the controller is configured to couple the exterior manual actuator with the deadbolt mechanism to enable the deadbolt mechanism to be operated by the exterior manual actuator upon receiving an indication that an approved fingerprint has been received at the fingerprint sensor.

22. The self-contained biometric deadbolt lock assembly of claim 21, further comprising a controlled actuator coupled to the deadbolt mechanism and couplable to the exterior manual actuator, the controlled actuator comprising a push-type actuator housed within the exterior manual actuator; wherein the controller is further configured to cause the push-type actuator to activate, thereby causing the controlled actuator to engage the exterior manual actuator, upon receiving the indication that an approved fingerprint has been received.

23. The self-contained biometric deadbolt lock assembly of claim 22, wherein upon activation of the push-type actuator, annular rotation of the exterior manual actuator operates the deadbolt lock to move the deadbolt mechanism.

24. The self-contained biometric deadbolt lock assembly of claim 23, wherein the manual actuator comprises a depressible actuator comprising a depressed position in which the push-type actuator can engage the depressible actuator and a raised position in which the push-type actuator cannot engage the depressible actuator.

25. The self-contained biometric deadbolt lock assembly of claim 24, wherein movement of the depressible actuator from the depressed position to the raised position disengages the push-type actuator from the depressible actuator if it was engaged in the depressed position.

26. The self-contained biometric deadbolt lock assembly of claim 25, wherein the exterior manual actuator is biased from an actuated position to a rest position, wherein in the rest position the depressible actuator is aligned with the push-type actuator.

27. The self-contained biometric deadbolt lock assembly of claim 21, wherein the controller is configured to receive fingerprint data relating to a plurality of authorized fingerprints through the fingerprint sensor in the assembly housing.

28. The self-contained biometric deadbolt lock assembly of claim 21, further comprising an external cable connection in the assembly housing and accessible from outside of the assembly housing.

29. The self-contained biometric deadbolt lock assembly of claim 28, wherein the electrical port is configured for transmitting at least one of power to the controller and communication between an external data source and the controller.

30. The self-contained biometric deadbolt lock assembly of claim 21, wherein the at least one visual indicator comprises a light emitting diode.

31. The biometric deadbolt lock assembly of claim 21, wherein the exterior manual actuator comprises a rotatable knob.

32. The biometric deadbolt lock assembly of claim 21, wherein the exterior manual actuator further comprises a first engagement mechanism, the biometric deadbolt lock assembly further comprising a second engagement mechanism operatively associated with the deadbolt mechanism, wherein the first engagement mechanism couples with the second engagement mechanism when the controller couples the exterior manual actuator with the deadbolt mechanism.

33. The biometric deadbolt lock assembly of claim 32, wherein the first and second engagement mechanisms each comprise at least one engagement tooth and at least one disengagement ramp.

34. A method of operating a self-contained biometric deadbolt lock assembly, the method comprising:

receiving fingerprint data through a fingerprint sensor in and accessible from outside of a housing of the deadbolt lock assembly;

comparing the fingerprint data received with approved fingerprint data stored in memory associated with a controller in the assembly housing that is powered by at least one battery in the assembly housing;

initiating through the controller a coupling of an exterior manual actuator of the deadbolt lock assembly with a deadbolt mechanism of the deadbolt lock assembly such that rotation of the exterior manual actuator causes movement of the deadbolt mechanism when the exterior manual actuator is coupled with the deadbolt mechanism;

visually indicating that the exterior manual actuator is engaged with the deadbolt mechanism through an interior visual indicator on an interior side of the deadbolt lock assembly; and uncoupling the exterior manual actuator from the deadbolt mechanism when the interior visual indicator is actuated.

35. The method of claim 34, further comprising visually indicating through a light emitting diode in the assembly housing that is visible from outside of the housing if the received fingerprint data is approved fingerprint data.

36. The method of claim 34, further comprising automatically aligning the exterior manual actuator after rotation.

37. The method of claim 34, further comprising automatically uncoupling the exterior manual actuator from the deadbolt mechanism regardless of whether the at least one battery has sufficient power to uncouple the exterior manual actuator from the deadbolt mechanism.

38. The biometric deadbolt lock assembly of claim 1, wherein the exterior manual actuator can be rotated freely when the first and second engagement mechanism are not engaged.

39. The biometric deadbolt lock assembly of claim 21, wherein the exterior manual actuator can be rotated freely when the exterior manual actuator is not engaged with the deadbolt mechanism.

* * * * *